US012668852B2

(12) United States Patent
Hiroshima et al.

(10) Patent No.: US 12,668,852 B2
(45) Date of Patent: Jun. 30, 2026

(54) STEEL SHEET AND METHOD OF MANUFACTURING THE SAME

(71) Applicant: NIPPON STEEL CORPORATION, Tokyo (JP)

(72) Inventors: Hideto Hiroshima, Tokyo (JP); Takashi Yasutomi, Tokyo (JP); Eisaku Sakurada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 720 days.

(21) Appl. No.: 18/031,104

(22) PCT Filed: Nov. 18, 2021

(86) PCT No.: PCT/JP2021/042399
§ 371 (c)(1),
(2) Date: Apr. 10, 2023

(87) PCT Pub. No.: WO2022/180954
PCT Pub. Date: Sep. 1, 2022

(65) Prior Publication Data

US 2023/0416859 A1 Dec. 28, 2023

(30) Foreign Application Priority Data

Feb. 26, 2021 (JP) ..... 2021-030350

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 6/002* (2013.01); *C21D 6/005* (2013.01);
(Continued)

(58) Field of Classification Search
None
See application file for complete search history.

(56) References Cited

U.S. PATENT DOCUMENTS

2016/0068937 A1* 3/2016 Nakajima ..... C21D 1/20 148/330
2016/0138141 A1* 5/2016 Nakajima ..... C23C 2/06 148/307
(Continued)

FOREIGN PATENT DOCUMENTS

EP 2 987 883 A1 2/2016
JP 2015-147957 A 8/2015
(Continued)

*Primary Examiner* — Brian D Walck
(74) *Attorney, Agent, or Firm* — Birch, Stewart, Kolasch & Birch, LLP

(57) ABSTRACT

This steel sheet has a predetermined chemical composition, has a microstructure in which a number density of alloy carbides present at grain boundaries and having a major axis of 10 to 100 nm is $1.0\times10^{8}$ to $1.0\times10^{11}/cm^{2}$ and a number density of alloy carbides present in grains and having a major axis of 10 nm or less is $1.0\times10^{16}$ to $1.0\times10^{19}/cm^{3}$, and has a tensile strength of 1,030 MPa or more.

6 Claims, 1 Drawing Sheet

(51) Int. Cl.

| | |
|---|---|
| ***C21D 6/00*** | (2006.01) |
| ***C21D 8/02*** | (2026.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.

CPC ..... *C21D 6/008* (2013.01); *C21D 8/02* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/001* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

| | | | | |
|---|---|---|---|---|
| 2018/0119240 | A1 | 5/2018 | Tanaka et al. | |
| 2019/0233926 | A1 | 8/2019 | Sano et al. | |
| 2022/0025497 | A1 * | 1/2022 | Nagano | C22C 38/14 |

FOREIGN PATENT DOCUMENTS

| | | | | |
|---|---|---|---|---|
| JP | 2016-50334 | A | 4/2016 | |
| JP | 6690804 | B1 | 4/2020 | |
| WO | WO 2018/026015 | A1 | 2/2018 | |
| WO | WO-2020071523 | A1 * | 4/2020 | C22C 38/44 |

* cited by examiner

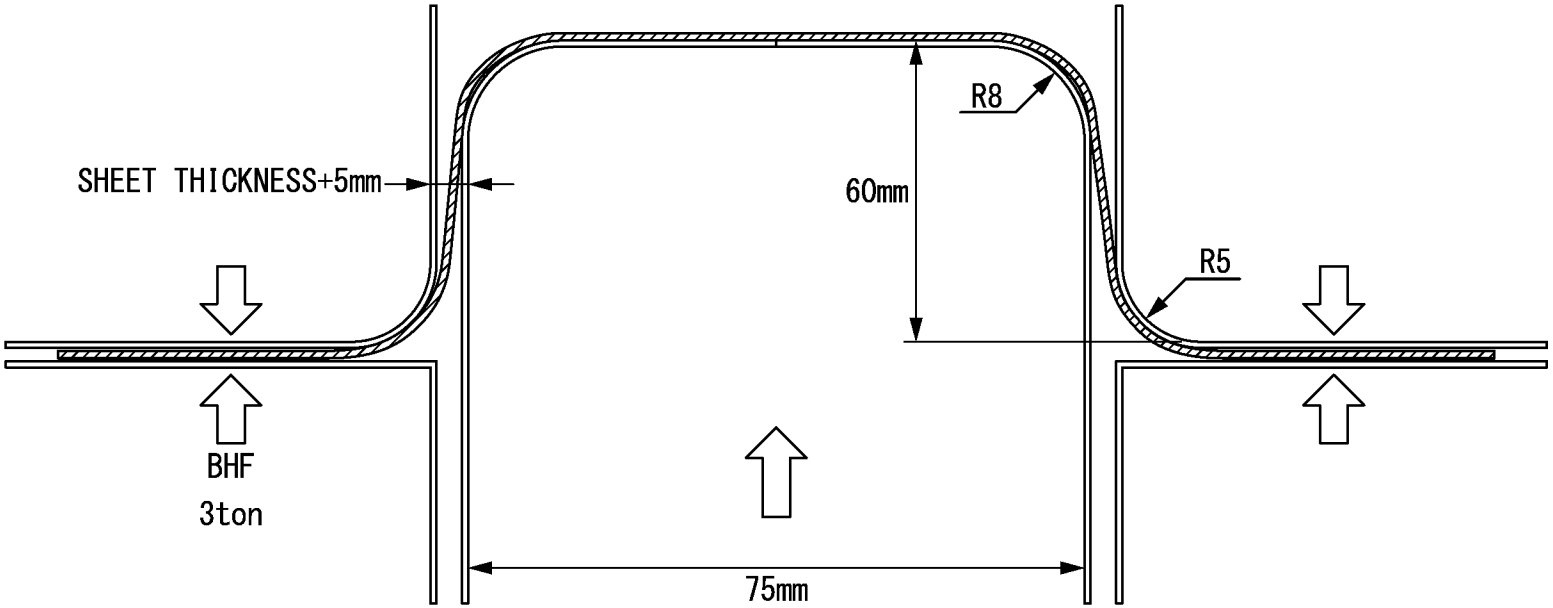
R5
R8
60mm
75mm
SHEET THICKNESS+5mm
BHF
3ton

STEEL SHEET AND METHOD OF MANUFACTURING THE SAME

TECHNICAL FIELD OF THE INVENTION

The present invention relates to a steel sheet and a method of manufacturing the same.

Priority is claimed on Japanese Patent Application No. 2021-030350, filed Feb. 26, 2021, the content of which is incorporated herein by reference.

RELATED ART

In recent years, a reduction in weight of vehicles and mechanical components has proceeded. The reduction in weight of vehicles and mechanical components can be achieved by designing a component shape into an optimum shape and securing stiffness. Furthermore, a reduction in weight of a blank formed component such as a press-formed component can be achieved by reducing a sheet thickness of a component material. However, in a case of securing strength properties of a component such as static fracture strength and yield strength while reducing the sheet thickness, it is necessary to use a high strength material. In particular, for a vehicle suspension component, application of a steel sheet having higher strength has begun to be studied.

The vehicle suspension component is manufactured by subjecting a steel sheet to burring, stretch flange, bending, and the like. Therefore, the steel sheet applied to such vehicle suspension components is required to have not only high strength but also excellent formability, particularly excellent hole expansibility. In addition, the steel sheet is required to have a little deterioration in bendability after working.

For example, Patent Document 1 discloses a high-strength thin steel sheet having an excellent delayed fracture resistance property of a sheared cross section, in which ferrite having an area ratio of 95% or more is a primary phase, and the ferrite has a microstructure in which a ratio dN/dL of an average ferrite grain size dN in a sheet thickness direction to an average ferrite grain size dL in a rolling direction is 0.5 or more, an average grain size defined by $(2\times dL\times dN)/(dL+dN)$ is 5 μm or less, and a precipitation density of precipitates of less than 10 nm is $1.0\times10^5/\mu m^3$ or more.

Patent Document 2 discloses a hot-dip galvannealed steel sheet including: by area ratio, 10% or more and 90% or less of ferrite and 10% or more of tempered martensite and tempered bainite, in which the sum of the ferrite, the tempered martensite and the tempered bainite is 90% or more, carbides having a major axis of 50 nm or more and 300 nm or less are present in ferrite grains at a number density of $20/\mu m^2$ or more, and a two-dimensional homogeneous distribution ratio S defined by Expression (1) ($S=Sy^2/Sx^2$) is 0.75 or more and 1.30 or less.

However, in Patent Documents 1 and 2, deterioration in bendability after working is not considered. In addition, the present inventors found that in the techniques described in Patent Documents 1 and 2, it is necessary to further enhance the strength and hole expansibility.

PRIOR ART DOCUMENT

Patent Document

[Patent Document 1] Japanese Unexamined Patent Application, First Publication No. 2015-147957
[Patent Document 2] Japanese Patent No. 6690804

DISCLOSURE OF THE INVENTION

Problems to be Solved by the Invention

An object of the present invention is to provide a steel sheet having high strength, excellent hole expansibility, and a little deterioration in bendability after working. Another object of the present invention is to provide a method of manufacturing a steel sheet, in which the steel sheet can be manufactured.

Means for Solving the Problem

As a result of studying a method for obtaining the above-described steel sheet, the present inventors found that by strictly controlling a chemical composition and controlling a number density of alloy carbides present at grain boundaries and in grains, high strength and excellent hole expansibility can be achieved and deterioration in bendability after working can be reduced. In addition, the present inventors found that the steel sheet can be manufactured, in particular, by strictly controlling conditions in a rough rolling step and a reheating step.

The gist of the present invention made on the basis of the above-mentioned findings is as follows.

(1) An steel sheet according to an aspect of the present invention includes, as a chemical composition, by mass %:
C: 0.030% to 0.180%;
Si: 0.030% to 1.400%;
Mn: 1.60% to 3.00%;
Al: 0.010% to 0.700%;
P: 0.0800% or less;
S: 0.0100% or less;
N: 0.0050% or less;
Ti: 0.020% to 0.180%;
Nb: 0.010% to 0.050%;
Mo: 0% to 0.600%;
V: 0% to 0.300%;
a sum of Ti, Nb, Mo, and V: 0.100% to 1.130%;
B: 0% to 0.0030%;
Cr: 0% to 0.500%; and
a remainder including Fe and impurities,
in which a microstructure of the steel sheet contains, by area %,
bainite: 80.0% or more,
a sum of fresh martensite and tempered martensite: 20.0% or less,
a sum of pearlite, ferrite, and austenite: 20.0% or less,
a number density of alloy carbides present at grain boundaries and having a
major axis of 10 to 100 nm is $1.0\times10^8$ to $1.0\times10^{11}/cm^2$,
a number density of alloy carbides present in grains and having a major axis of 10 nm or less is $1.0\times10^{16}$ to $1.0\times10^{19}/cm^3$, and
a tensile strength of the steel sheet is 1,030 MPa or more.

(2) In the steel sheet according to (1), a proportion of an area ratio of the tempered martensite in a sum of area ratios of the fresh martensite and the tempered martensite may be 80.0% or more.

(3) The steel sheet according to (1) or (2) may contain, as the chemical composition, by mass %, one or two or more selected from the group consisting of Mo: 0.001% to 0.600%, V: 0.010% to 0.300%, B: 0.0001% to 0.0030%, and Cr: 0.001% to 0.500%.

(4) A method of manufacturing the steel sheet according to (1) according to another aspect of the present invention, includes:

heating a slab having the chemical composition according to (1) and performing rough rolling of four passes or more in a temperature range of 1,000° C. to 1,300° C.;

performing finish rolling after the rough rolling so that a final rolling reduction is 24% to 60% and a finish rolling temperature is in a temperature range of 960° C. to 1,060° C.;

performing cooling after the finish rolling so that an average cooling rate in a temperature range of 900° C. to 650° C. is 30° C./sec or faster;

performing coiling in a temperature range of 400° C. to 580° C. after the cooling; and after the coiling, performing heating to a temperature range of 600° C. to 750° C. at an average heating rate of 0.2 to 5.0° C./sec, performing holding in the temperature range of 600° C. to 750° C. for 60 to 3,010 seconds, and performing cooling so that an average cooling rate in a temperature range of 500° C. to 700° C. is 10° C./sec or faster, in which, in the rough rolling, a temperature difference between a final pass and a pass one pass before the final pass is set to 50° C. or less, a rolling reduction in first to third passes is set to 10% to 30%, and a rolling reduction in fourth and subsequent passes is set to 15% to 50%.

Effects of the Invention

According to the above aspect according to the present invention, it is possible to provide a steel sheet having high strength, excellent hole expansibility, and a little deterioration in bendability after working.

In addition, according to the other aspect according to the present invention, it is possible to provide a method of manufacturing the steel sheet in which the steel sheet can be manufactured.

BRIEF DESCRIPTION OF THE DRAWINGS

FIG. 1 is a diagram for describing a method of manufacturing a hat component in an example.

EMBODIMENTS OF THE INVENTION

Hereinafter, a steel sheet according to the present embodiment and a method of manufacturing the same will be described in detail. However, the present invention is not limited to configurations disclosed in the present embodiment, and various changes can be made without departing from the gist of the present invention.

In a numerical limit range described with "to" in the following description, a lower limit and an upper limit are included in the range. Numerical values indicated as "less than" or "more than" do not fall within the numerical range. All "%" with respect to a chemical composition refer to "mass %".

The steel sheet according to the present embodiment includes C: 0.030% to 0.180%, Si: 0.030% to 1.400%, Mn: 1.60% to 3.00%. Al: 0.010% to 0.700%, P: 0.0800% or less, S: 0.0100% or less, N: 0.0050% or less, Ti: 0.020% to 0.180%, Nb: 0.010% to 0.050%, and a remainder including Fe and impurities. Hereinafter, each element will be described in detail.

C: 0.030% to 0.180%

C is an element necessary for obtaining a desired tensile strength of the steel sheet. When a C content is less than 0.030%, a desired tensile strength cannot be obtained. Therefore, the C content is set to 0.030% or more. The C content is preferably 0.060% or more, more preferably 0.080% or more, and even more preferably 0.085% or more, 0.090% or more, 0.095% or more, or 0.100% or more.

On the other hand, when the C content is more than 0.180%, a sum of area ratios of fresh martensite and the tempered martensite becomes excessive, and hole expansibility of the steel sheet deteriorates. Therefore, the C content is set to 0.180% or less. The C content is preferably 0.170% or less, and more preferably 0.150% or less.

Si: 0.030% to 1.400%

Si is an element that improves tensile strength of the steel sheet by solid solution strengthening. When a Si content is less than 0.030%, a desired tensile strength cannot be obtained. Therefore, the Si content is set to 0.030% or more. The Si content is preferably 0.040% or more, and more preferably 0.050% or more.

On the other hand, when the Si content is more than 1.400%, an area ratio of retained austenite increases, and the hole expansibility of the steel sheet deteriorates. Therefore, the Si content is set to 1.400% or less. The Si content is preferably 1.100% or less, and more preferably 1.000% or less.

Mn: 1.60% to 3.00%

Mn is an element necessary for improving the strength of the steel sheet. When a Mn content is less than 1.60%, an area ratio of ferrite becomes too high, and a desired tensile strength cannot be obtained. Therefore, the Mn content is set to 1.60% or more. The Mn content is preferably 1.80% or more, and more preferably 2.00% or more.

On the other hand, when the Mn content is more than 3.00%, toughness of a cast slab deteriorates and hot rolling cannot be performed. Therefore, the Mn content is set to 3.00% or less. The Mn content is preferably 2.70% or less, and more preferably 2.50% or less.

Al: 0.010% to 0.700%

Al is an element that acts as a deoxidizing agent and improves cleanliness of steel. When an Al content is less than 0.010%, a sufficient deoxidizing effect cannot be obtained, and a large amount of inclusions (oxides) are formed in the steel sheet. Such inclusions deteriorate the hole expansibility of the steel sheet. Therefore, the Al content is set to 0.010% or more. The Al content is preferably 0.020% or more, and more preferably 0.030% or more.

On the other hand, when the Al content is more than 0.700%, casting becomes difficult. Therefore, the Al content is set to 0.700% or less. The Al content is preferably 0.600% or less, and more preferably 0.100% or less.

P: 0.0800% or Less

P is an element that segregates in a sheet thickness center portion of the steel sheet. In addition, P is also an element that embrittles a welded part. When a P content is more than 0.0800%, the hole expansibility of the steel sheet deteriorates. Therefore, the P content is set to 0.0800% or less. The P content is preferably 0.0200% or less, and more preferably 0.0100% or less.

The lower the P content is, the more preferable it is, and the P content is preferably 0%. However, when the P content is excessively reduced, a dephosphorization cost significantly increases. Therefore, the P content may be set to 0.0005% or more.

S: 0.0100% or Less

S is an element that embrittles a slab by being present as a sulfide. In addition. S is also an element that deteriorates workability of the steel sheet. When a S content is more than 0.0100%, the hole expansibility of the steel sheet deteriorates. For this reason, the S content is set to 0.0100% or less. The S content is preferably 0.0080% or less, and more preferably 0.0050% or less.

The lower the S content is, the more preferable it is, and the S content is preferably 0%. However, when the S content is excessively reduced, a desulfurization cost significantly increases. Therefore, the S content may be set to 0.0005% or more.

N: 0.0050% or Less

N is an element that forms coarse nitrides in steel and deteriorates the workability of the steel sheet. When a N content is more than 0.0050%, the hole expansibility of the steel sheet deteriorates. Therefore, the N content is set to 0.0050% or less. The N content is preferably 0.0040% or less, and more preferably 0.0035% or less.

The lower the N content is, the more preferable it is, and the N content is preferably 0%. However, when the N content is excessively reduced, a denitration cost significantly increases. Therefore, the N content may be set to 0.0005% or more.

Ti: 0.020% to 0.180%

Ti is an element that increases the strength of the steel sheet by forming fine nitrides in the steel. When a Ti content is less than 0.020%, a desired tensile strength cannot be obtained. Therefore, the Ti content is set to 0.020% or more. The Ti content is preferably 0.050% or more, and more preferably 0.080% or more.

On the other hand, when the Ti content is more than 0.180%, the hole expansibility of the steel sheet deteriorates. Therefore, the Ti content is set to 0.180% or less. The Ti content is preferably 0.160% or less, and more preferably 0,150% or less.

Nb: 0.010% to 0.050%

Nb is an element that suppresses abnormal grain growth of austenite grains during hot rolling. In addition, Nb is also an element that increases the strength of the steel sheet by forming fine alloy carbides. When a Nb content is less than 0.010%, a desired tensile strength cannot be obtained. Therefore, the Nb content is set to 0.010% or more. The Nb content is preferably 0.013% or more, and more preferably 0.015% or more.

On the other hand, when the Nb content is more than 0.050%, the toughness of the cast slab deteriorates and hot rolling cannot be performed. Therefore, the Nb content is set to 0.050% or less. The Nb content is preferably 0.040% or less, and more preferably 0.035% or less.

Sum of Ti, Nb, Mo, and V: 0.100% to 1.130%

In the present embodiment, a sum of amounts of Ti and Nb described above and Mo and V described below is controlled. When the sum of the amounts of these elements is less than 0.100%, the effect of forming fine alloy carbides to increase the strength of the steel sheet cannot be sufficiently obtained, and a desired tensile strength cannot be obtained. Therefore, the sum of the amounts of these elements is set to 0.100% or more. Not all of Ti, Nb, Mo, and V needs to be included, and the above effect can be obtained as long as the amount of any one thereof is 0.100% or more. The sum of the amounts of these elements is preferably 0.150% or more, more preferably 0.200% or more, and even more preferably 0.230% or more.

On the other hand, when the sum of the amounts of these elements is more than 1.130%, the hole expansibility of the steel sheet deteriorates. Therefore, the sum of the amounts of these elements is set to 1.130% or less. The sum of the amounts of these elements is preferably 1.000% or less, and more preferably 0.500% or less.

The remainder of the chemical composition of the steel sheet according to the present embodiment may include Fe and impurities. In the present embodiment, the impurities mean those incorporated in from ore as a raw material, scrap, a manufacturing environment, or the like, or those allowed within a range that does not adversely affect the steel sheet according to the present embodiment.

The steel sheet according to the present embodiment may contain the following optional elements instead of a portion of Fe. A lower limit of amounts of the optional elements in a case where the following optional elements are not included is 0%. Hereinafter, each optional element will be described.

Mo: 0.001% to 0.600%

Mo is an element that increases the strength of the steel sheet by forming fine alloy carbides in the steel. In order to reliably obtain this effect, it is preferable that a Mo content is set to 0.001% or more.

On the other hand, when the Mo content is more than 0.600%, the hole expansibility of the steel sheet deteriorates. Therefore, the Mo content is set to 0.600% or less.

V: 0.010% to 0.300%

V is an element that increases the strength of the steel sheet by forming fine alloy carbides in the steel. In order to reliably obtain this effect, it is preferable that a V content is set to 0.010% or more.

On the other hand, when the V content is more than 0.300%, the hole expansibility of the steel sheet deteriorates. Therefore, the V content is set to 0.300% or less.

B: 0.0001% to 0.0030%

B is an element that suppresses the formation of ferrite in a cooling step and increase the strength of the steel sheet. In order to reliably obtain this effect, it is preferable that a B content is set to 0.0001% or more.

On the other hand, even if B is contained in an amount of more than 0.0030%, the above effect is saturated. Therefore, the B content is set to 0.0030% or less.

Cr: 0.001% to 0.500%

Cr is an element that exhibits an effect similar to that of Mn. In order to reliably obtain the effect of increasing the strength of the steel sheet by the inclusion of Cr, a Cr content is preferably set to 0.001% or more.

On the other hand, even if Cr is contained in an amount of more than 0.500%, the above effect is saturated. Therefore, the Cr content is set to 0.500% or less.

The chemical composition of the steel sheet described above may be analyzed using a spark discharge optical emission spectrometer or the like. As C and S, values identified by burning in an oxygen stream using a gas component analyzer or the like and performing measurement by an infrared absorption method are adopted. In addition, as N, a value identified by melting a test piece collected from a steel sheet in a helium stream and performing measurement by a thermal conductivity method is adopted.

Next, a microstructure of the steel sheet according to the present embodiment will be described.

The microstructure of the steel sheet according to the present embodiment includes, by area %, bainite: 80.0% or more, a sum of fresh martensite and tempered martensite: 20.0% or less, and a sum of pearlite, ferrite, and austenite: 20.0% or less, in which a number density of alloy carbides that are present at grain boundaries and have a major axis of 10 to 100 nm is $1.0\times10^{8}$ to $1.0\times10^{10}/cm^2$, and a number density of alloy carbides that are present in grains and have a major axis of 10 nm or less is $1.0\times10^{16}$ to $1.0\times10^{19}/cm^3$.

In the present embodiment, the microstructure at a thickness ¼ position from a surface (a region from a thickness ⅛ depth from the surface to a thickness ⅜ depth from the surface) is specified. The reason is that the microstructure at this position represents a representative microstructure of the steel sheet.

Bainite: 80.0% or More

Bainite is a microstructure having excellent hole expansibility while having a predetermined strength. When an area ratio of the bainite is less than 80.0%, a desired tensile strength and/or hole expansibility cannot be obtained. Therefore, the area ratio of bainite is set to 80.0% or more. The area ratio of the bainite is preferably 81.0% or more, more preferably 82.0% or more, and even more preferably 83.0% or more.

An upper limit of the area ratio of the bainite is not particularly limited, and may be set to 100.0% or less, 95.0% or less, or 90.0% or less.

Sum of Fresh Martensite and Tempered Martensite: 20.0% or Less

Fresh martensite and tempered martensite have an effect of increasing the strength of the steel sheet but have low local deformability. Therefore, increasing area ratios of fresh martensite and tempered martensite deteriorates the hole expansibility of the steel sheet. When a sum of the area ratios of fresh martensite and tempered martensite is more than 20.0%, the hole expansibility of the steel sheet deteriorates. Therefore, the sum of the area ratios of fresh martensite and tempered martensite is set to 20.0% or less. The sum of the area ratios of the fresh martensite and tempered martensite is preferably 15.0% or less, more preferably 10.0% or less, and even more preferably 5.0% or less.

A lower limit of the sum of the area ratios of fresh martensite and tempered martensite is not particularly limited, and may be set to 0.0% or more, 0.5% or more, or 1.0% or more.

Proportion of Area Ratio of Tempered Martensite: 80.0% or More of Sum of Area Ratios of Fresh Martensite and Tempered Martensite By increasing a proportion of the area ratio of tempered martensite in the sum of the area ratios of fresh martensite and tempered martensite, the hole expansibility of the steel sheet can be further increased. Therefore, the proportion of the area ratio of tempered martensite to the sum of the area ratios of fresh martensite and tempered martensite may be set to 80.0% or more. The proportion of the area ratio of tempered martensite in the sum of the area ratios of fresh martensite and tempered martensite is preferably higher, more preferably 90.0% or more, and may be 100.0%.

The proportion of the area ratio of tempered martensite can be obtained by {area ratio of tempered martensite/(sum of area ratios of fresh martensite and tempered martensite)}×100.

Sum of Pearlite, Ferrite and Austenite: 20.0% or Less

Ferrite and austenite are microstructures that deteriorate the strength of the steel sheet. Pearlite is a microstructure that deteriorates the hole expansibility of a steel sheet. When a sum of area ratios of these microstructures is more than 20.0%, a desired tensile strength and/or hole expansibility cannot be obtained. Therefore, the sum of the area ratios of these microstructures is set to 20.0% or less. The sum of the area ratios of these microstructures is preferably 17.0% or less, and more preferably 15.0% or less.

A lower limit of the sum of the area ratios of pearlite, ferrite, and austenite is not particularly limited, and may be 0.0% or more, 5.0% or more, or 10.0% or more.

Hereinafter, a method of measuring the area ratio of each microstructure will be described.

A test piece is collected from a cross section parallel to a rolling direction of the steel sheet so that a microstructure at a thickness ¼ depth from the surface (a region from a thickness ⅛ depth from the surface to a thickness ⅜ depth from the surface) and at a center position in a sheet width direction can be observed.

The cross section of the test piece is polished using #600 to #1500 silicon carbide paper and is thereafter mirror-finished using a liquid obtained by dispersing a diamond powder having a particle size of 1 to 6 μm in a diluted solution such as alcohol or in pure water. Next, the cross section of the test piece is polished at room temperature using colloidal silica containing no alkaline solution to remove strain introduced into a surface layer of the sample. At a certain position in a longitudinal direction of the cross section of the sample, in order to observe the thickness ¼ depth position from the surface, a region with a length of 50 μm from the thickness ⅛ depth from the surface to the thickness ⅜ depth from the surface is measured at a measurement interval of 0.1 μm by an electron backscattering diffraction method, thereby obtaining crystal orientation information.

For the measurement, an EBSD apparatus including a thermal field-emission scanning electron microscope (JSM-7001F manufactured by JEOL Ltd.) and an EBSD detector (DVC5 type detector manufactured by TSL solutions) is used. In this case, a degree of vacuum in the EBSD apparatus is set to $9.6\times10^{-5}$ Pa or less, an accelerating voltage is set to 15 kV, an irradiation current level is set to 13, and an irradiation level of an electron beam is set to 62. From the obtained crystal orientation information, the area ratio of austenite is calculated using the "Phase Map" function installed in the software "OIM Analysis (registered trademark)" attached to the EBSD analyzer. The area ratio of austenite is thus obtained. Those having an fcc crystal structure are determined to be austenite.

Next, those having a bcc crystal structure are determined to be bainite, ferrite, pearlite, fresh martensite, and tempered martensite. For these regions, using the "Grain Orientation Spread" function installed in the software "OIM Analysis (registered trademark)" attached to the EBSD analyzer, a region having a "Grain Orientation Spread" of 1° or less is extracted as ferrite under a condition in which a 15° grain boundary is regarded as a grain boundary. By calculating the area ratio of the extracted ferrite, the area ratio of ferrite is obtained.

Subsequently, under a condition in which a 5° grain boundary is regarded as a grain boundary in the remaining region (a region having a "Grain Orientation Spread" of more than 1°), when a maximum value of "Grain Average IQ" of the ferrite region is indicated as Iα, a region of more than Iα/2 is extracted as bainite, and a region of Iα2 or less is extracted as "pearlite, fresh martensite, and tempered martensite". By calculating the area ratio of the extracted bainite, the area ratio of bainite is obtained.

For the extracted "pearlite, fresh martensite and tempered martensite", pearlite, fresh martensite and tempered martensite are distinguished by the following method.

In order to observe the same region as the EBSD measurement region by SEM, a Vickers indentation is imprinted in the vicinity of the observation position. Thereafter, contamination of a surface layer is removed by polishing while leaving a microstructure of the observed section, and nital etching is performed. Next, the same visual field as the EBSD observed section is observed by SEM at a magnification of 3,000-fold. Among the regions determined to be "pearlite, fresh martensite, and tempered martensite" in the EBSD measurement, a region having a substructure in the grains and having cementite precipitated with a plurality of variants is determined to be tempered martensite. A region having cementite precipitated in a lamellar form is determined to be pearlite. A region having high brightness and having no substructure exposed by etching is determined as fresh martensite. By calculating the area ratio of each microstructure, the area ratios of tempered martensite, pearlite, and fresh martensite are obtained.

For the removal of the contamination on the surface layer of the observed section, a method such as buffing using alumina particles having a particle size of 0.1 μm or less or Ar ion sputtering may be used.

Number Density of Alloy Carbides Present at Grain Boundaries and Having Major Axis of 10 to 100 nm: $1.0\times10^{8}$ to $1.0\times10^{11}/cm^2$ Spherical alloy carbides are present at grain boundaries. Under deformation such as bending, when a dislocation density accumulated by the deformation reaches a critical amount, microvoids are generated at an interface between the alloy carbides present at the grain boundaries and a primary phase (around the alloy carbides present at the grain boundaries). When a large amount of microvoids are generated at the grain boundaries, bendability significantly deteriorates. By finely dispersing a large amount of the alloy carbide in the grain boundaries, it is possible to disperse accumulation sites of dislocations. As a result, stress concentration can be relaxed even if microvoids are generated, so that deterioration in bendability after working can be reduced.

When the number density of the alloy carbides present at the grain boundaries and having a major axis of 10 to 100 nm is less than $1.0\times10^{8}/cm^2$, the deterioration in the bendability after working cannot be reduced. Therefore, the number density of the alloy carbide is set to $1.0\times10^{8}/cm^2$ or more. The number density of the alloy carbide is preferably $2.0\times10^{8}/cm^2$ or more, $5.0\times10^{8}/cm^2$ or more, or $1.0\times10^{9}/cm^2$ or more.

When the number density of the alloy carbides is more than $1.0\times10^{11}/cm^2$, the strength of the steel sheet decreases. Therefore, the number density of the alloy carbide is set to $1.0\times10^{11}/cm^2$ or less. The number density of the alloy carbide is preferably $5.0\times10^{10}/cm^2$ or less and $1.0\times10^{10}/cm^2$ or less.

In the present embodiment, the alloy carbides refer to carbides containing one or two or more of Ti, Nb, Mo, and V. In addition, the grain boundaries refer to boundaries having a crystal orientation difference of 1.0° or more in an analysis using EBSD described later.

In the present embodiment, since a minimum major axis of the alloy carbides that can be observed in a measurement method described later is 10 nm for the grain boundaries, the number density of the alloy carbides having a major axis of 10 nm or more is specified. In addition, when coarse alloy carbides having a major axis of more than 100 nm are present at the grain boundaries, microvoids are formed at an early stage of deformation, and necking occurs. Therefore, it is preferable that a number density of the alloy carbides having a major axis of more than 100 nm is low. However, as long as the number density of the alloy carbides present at the grain boundaries and having a major axis of 10 to 100 nm is within the above range, the alloy carbides having a major axis of more than 100 nm do not precipitate to an extent that the steel sheet according to the present embodiment is adversely affected. Therefore, it is not necessary to specify the number density of the alloy carbides having a major axis of more than 100 nm.

The number density of the alloy carbides present at the grain boundaries and having a major axis of 10 to 100 nm is measured by the following method.

A test piece is collected so that a sheet thickness cross section parallel to the rolling direction is an observed section. After polishing the observed section of the test piece, nital etching is performed. For five or more visual fields in a region from a thickness ⅛ depth from the surface to a thickness ⅜ depth from the surface in the observed section, crystal orientations are analyzed by an electron backscatter diffraction (EBSD) method using a field emission scanning electron microscope (FE-SEM). Each visual field is a continuous region. From a crystal orientation map thus obtained, a boundary having a crystal orientation difference of 1.0° or more is regarded as a grain boundary.

The same region as the observed visual field by the EBSD is observed using a scanning electron microscope (SEM) at a magnification of 5,000 to 30,000-fold. For each visual field, the number of alloy carbides having a major axis of 10 to 100 nm present on boundaries determined to be grain boundaries by EBSD is calculated. By dividing the number of the obtained alloy carbides by the total observed area, the number density of the alloy carbides present at the grain boundaries and having a major axis of 10 to 100 nm is obtained.

Whether or not the observed precipitate is an alloy carbide is determined by performing point analysis by SEM-EDS on particles having a brightness lower than that of the iron primary phase in a visual field of a secondary electron image acquired by SEM observation, and precipitate in which a sum of peak intensities of Ti (Kα, Kβ), Nb (Kα), Mo (Lα), and V(Kα) is equal to or more than a peak intensity of Fe (Kα) is determined to be an alloy carbide.

Number Density of Alloy Carbides Present in Grains and Having Major Axis of 10 nm or Less: $1.0\times10^{16}$ to $1.0\times10^{19}$ $cm^3$ Plate-shaped alloy carbides are present in grains. By dispersing a large amount of fine alloy carbides in the grains, ferrite, bainite, fresh martensite, and tempered martensite undergo precipitation hardening.

When a number density of the alloy carbides present in the grains and having a major axis of 10 nm or less is less than $1.0\times10^{16}/cm^3$, precipitation hardening cannot be sufficiently achieved, and a desired strength cannot be obtained. Therefore, the number density of the alloy carbides present in the grains and having a major axis of 10 nm or less is set to $1.0\times10^{16}/cm^3$ or more. The number density of the alloy carbides is preferably $5.0\times10^{16}/cm^3$ or more or $1.0\times10^{17}/cm^3$ or more.

When the number density of the alloy carbides is more than $1.0\times10^{19}/cm^3$, the hole expansibility deteriorates. Therefore, the number density of the alloy carbides is set to $1.0\times10^{19}/cm^3$ or less. The number density of the alloy carbides is preferably $5.0\times10^{18}/cm^3$ or less or $1.0\times10^{18}/cm^3$ or less.

The number density of the alloy carbides present in the grains and having a major axis of 10 nm or less is measured by the following method.

The same region as the above-described observed visual field by EBSD is observed using a transmission electron microscope (TEM) at a magnification of 100,000 to 1,000,000-fold. For each visual field, the number of alloy carbides present at boundaries determined to be grain boundaries by EBSD and having a major axis of 10 nm or less is calculated. By dividing the number of the obtained alloy carbides by the total observed volume excluding the grain boundaries, the number density of the alloy carbides present in the grains and having a major axis of 10 nm or less is obtained. For the observation by TEM, a thin film sample is collected from the test piece.

Whether or not the observed precipitate is an alloy carbide is determined by allowing an electron beam to be incident in an αFe[100] direction and performing dark-field microscopy with an excitation condition of $g_{MC}$=200 because ferrite and precipitates have a Baker-Nutting orientation relationship. In addition, a thickness of the sample is acquired by measuring a thin film surface in a perpendicular direction by SEM.

Tensile Strength TS: 1,030 MPa or More

The steel sheet according to the present embodiment has a tensile strength of 1,030 MPa or more. When the tensile strength is less than 1,030 MPa, the steel sheet cannot be suitably applied to various vehicle suspension components. The tensile strength is preferably 1,050 MPa or higher or 1,150 MPa or higher.

The higher the tensile strength is, the more preferable it is, but the tensile strength may be set to 1,450 MPa or less.

The tensile strength is measured by performing a tensile test in accordance with JIS Z 2241:2011 using a No. 5 test piece of JIS Z 2241:2011. A collecting position of the tensile test piece is a center position in the sheet width direction, and a direction perpendicular to the rolling direction is a longitudinal direction.

Hole Expansion Ratio λ: 30% or More

The steel sheet according to the present embodiment may have a hole expansion ratio of 30% or more. The hole expansion ratio may be set to 35% or more, 40% or more, or 45% or more.

The hole expansion ratio is measured by performing a hole expansion test in accordance with JIS Z 2256:2020.

The steel sheet according to the present embodiment may be a surface-treated steel sheet provided with a plating layer on the surface for the purpose of improving corrosion resistance or the like. The plating layer may be an electroplating layer or a hot-dip plating layer. Examples of the electroplating layer include electrogalvanizing, and electro Zn—Ni alloy plating. Examples of the hot-dip plating layer include hot-dip galvanizing, hot-dip galvannealing, hot-dip aluminum plating, hot-dip Zn—Al alloy plating, hot-dip Zn—Al—Mg alloy plating, and hot-dip Zn—Al—Mg—Si alloy plating. A plating adhesion amount is not particularly limited and may be the same as in the related art. In addition, it is also possible to further enhance the corrosion resistance by performing an appropriate chemical conversion treatment (for example, application and drying of a silicate-based chromium-free chemical conversion liquid) after plating.

Next, a method of manufacturing the steel sheet according to the present embodiment will be described.

The method of manufacturing the steel sheet according to the present embodiment includes:

- a rough rolling step of heating a slab having the above-described chemical composition and performing rough rolling of four passes or more in a temperature range of 1,000° C. to 1,300° C.:
  - a finish rolling step of performing finish rolling after the rough rolling so that a final rolling reduction is 24% to 60% and a finish rolling temperature is in a temperature range of 960° C. to 1,060° C.;
  - a cooling step of performing cooling after the finish rolling so that an average cooling rate in a temperature range of 900° C. to 650° C. is 30° C./sec or faster;
  - a coiling step of performing coiling in a temperature range of 400° C. to 580° C. after the cooling; and
  - a reheating step of, after the coiling, performing heating to a temperature range of 600° C. to 750° C. at an average heating rate of 0.2 to 5.0° C./sec, performing holding in the temperature range of 600° C. to 750° C. for 60 to 3,010 seconds, and performing cooling so that an average cooling rate in a temperature range of 500° C. to 700° C. is 10° C./sec or faster.

In addition, in the rough rolling step,

- a temperature difference between a final pass and a pass one pass before the final pass is set to 50° C. or less,
- a rolling reduction in first to third passes is set to 10% to 30%, and
- a rolling reduction in fourth and subsequent passes is set to 15% to 50%.

Hereinafter, each step will be described.

Rough Rolling Step

In the rough rolling step, the slab having the above-described chemical composition is heated, and is subjected to rough rolling of four passes or more in the temperature range of 1,000° C. to 1,300° C. In addition, in the rough rolling step, the temperature difference between the final pass and the pass one pass before the final pass is set to 50° C. or less, the rolling reduction in the first to third passes is set to 10% to 30%, and the rolling reduction in the fourth and subsequent passes is set to 15% to 50%.

When a temperature at which the rough rolling is performed is lower than 1,000° C., precipitation of alloy carbides progresses, and an excessive amount of alloy carbides precipitates at the grain boundaries after the subsequent reheating step is performed. As a result, deterioration in bendability after working cannot be reduced. Therefore, the rough rolling is performed in a temperature range of 1.000° C. or higher.

On the other hand, when the rough rolling is performed at 1,300° C. or higher, an increase in fuel cost is incurred. Therefore, the rough rolling is performed in a temperature range of 1,300° C. or lower.

In the rough rolling step, when the number of passes of the rough rolling performed in the temperature range of 1,000° C. to 1,300° C. is less than four, the rolling reduction per pass increases, and a load on a roughing mill increases. Therefore, rough rolling of four passes or more is performed in the temperature range of 1,000° C. to 1,300° C.

Although an upper limit of the number of passes is not particularly specified, the rough rolling performed in the temperature range of 1,000° C. to 1,300° C. may be, for example, 6 or less passes.

In the rough rolling step, when the temperature difference between the final pass and the pass one pass before the final pass is more than 50° C., austenite grain sizes become non-uniform, and coarsening of the alloy carbides progresses in the subsequent reheating step. As a result, a sufficient amount of the alloy carbides cannot be precipitated at the grain boundaries, and deterioration in bendability after working cannot be reduced. Therefore, the temperature difference between the final pass and the pass one pass before the final pass is set to 50° C. or less. The temperature difference is preferably 45° C. or lower or 40° C. or lower.

Specifically, the temperature difference referred to here is a difference between a slab surface temperature on an outlet side of the final pass and a slab surface temperature on an outlet side of the pass one pass before the final pass.

In the rough rolling step, when the rolling reduction in the first to third passes is less than 10% or when the rolling reduction in the fourth and subsequent passes is less than 15%, the grains are coarsened, a sufficient amount of alloy carbides cannot be precipitated at the grain boundaries, and the deterioration in the bendability after working cannot be reduced. Therefore, the rolling reduction in the first to third passes is set to 10% or more, and the rolling reduction in the fourth and subsequent passes is set to 15% or more.

In addition, when the rolling reduction in the first to third passes is more than 30%, or when the rolling reduction in the fourth and subsequent passes is more than 50%, alloy carbides precipitate, and the alloy carbides are coarsened in the subsequent reheating step. As a result, a sufficient amount of the alloy carbides cannot be precipitated at the grain boundaries, and deterioration in bendability after working cannot be reduced. The rolling reduction in the first to third passes is set to 30% or less, and the rolling reduction in the fourth and subsequent passes is set to 50% or less.

The rolling reduction referred to here does not mean a cumulative rolling reduction but means a rolling reduction per pass.

Finish Rolling Step

After the rough rolling, the finish rolling is performed so that the final rolling reduction (the rolling reduction in the final pass) is 24% to 60% and the finish rolling temperature is in the temperature range of 960° C. to 1,060° C.

When the rolling reduction in the final pass is less than 24%, recrystallization does not proceed sufficiently, the alloy carbides precipitated at the grain boundaries are coarsened, and a desired number density at the grain boundaries cannot be obtained. As a result, desired hole expansibility cannot be obtained and/or the deterioration in the bendability after working cannot be reduced. Therefore, the rolling reduction in the final pass is set to 24% or more. The final rolling reduction in the finish rolling is preferably 30% or more. An upper limit of the final rolling reduction in the finish rolling is set to 60% or less from the viewpoint of suppressing an increase in a facility load.

The final rolling reduction in the finish rolling can be represented by $(1-t/t_0)\times100(\%)$ when it is assumed that a sheet thickness after the final pass of the finish rolling is t and a sheet thickness before the final pass is to.

When the finish rolling temperature (the surface temperature of the steel sheet on the outlet side of the final pass of the finish rolling) is lower than 960° C., recrystallization does not proceed sufficiently, alloy carbides precipitated at the grain boundaries are coarsened, and a desired number density at the grain boundaries cannot be obtained. As a result, desired hole expansibility cannot be obtained and/or the deterioration in the bendability after working cannot be reduced. The finish rolling temperature is preferably 980° C. or higher. An upper limit of the finish rolling temperature is set to 1,060° C. or lower from the viewpoint of suppressing coarse grain sizes and from the viewpoint of suppressing deterioration in toughness of the steel sheet.

Cooling Step

After the finish rolling, cooling is performed so that the average cooling rate in the temperature range of 900° C. to 650° C. is 30° C./sec or faster. When the average cooling rate in the temperature range of 900° C. to 650° C. is slower than 30° C./sec, a large amount of ferrite and pearlite are formed, and a desired tensile strength cannot be obtained. Therefore, the average cooling rate in the temperature range of 900° C. to 650° C. is set to 30° C./sec or faster. The average cooling rate is preferably 50° C./sec or faster, and more preferably 80° C./sec or faster.

An upper limit of the average cooling rate in the temperature range of 900° C. to 650° C. is not particularly limited, and may be set to 300° C./sec or less or 200° C./sec or less.

The average cooling rate mentioned in the present embodiment is a value obtained by dividing a temperature difference between a start point and an end point in a set range by an elapsed time from the start point to the end point.

After performing the cooling in the temperature range of 900° C. to 650° C. at the above average cooling rate, cooling up to coiling is not particularly limited.

Coiling Step

After performing the above-described cooling, the steel sheet is coiled in the temperature range of 400° C. to 580° C. When a coiling temperature is lower than 400° C., fresh martensite and tempered martensite are excessively generated, and the hole expansibility of the steel sheet deteriorates. Therefore, the coiling temperature is set to 400° C. or higher. The coiling temperature is preferably 450° C. or higher.

In addition, when the coiling temperature is higher than 580° C., the amount of ferrite increases and a desired tensile strength cannot be obtained. In addition, a desired number density cannot be obtained in the grains. Therefore, the coiling temperature is set to lower than 580° C. The coiling temperature is preferably 560° C. or lower.

The steel sheet manufactured by the above method may be allowed to cool until the temperature reaches room temperature, or may be coiled and then water-cooled.

After the coiling, the coil may be uncoiled, pickled, and subjected to light reduction. When a cumulative rolling reduction in the light reduction is too high, a dislocation density increases, and there are cases where the hole expansibility of the steel sheet deteriorates. Therefore, in the case of performing the light reduction, the cumulative rolling reduction in the light reduction is preferably set to 15% or less.

The cumulative rolling reduction of the light reduction can be represented by $(1-t/t_0)\times100(\%)$, when it is assumed that a sheet thickness after the light reduction is t and a sheet thickness before the light reduction is to.

Reheating Step

After the coiling or the light reduction, the heating to the temperature range of 600° C. to 750° C. is performed at the average heating rate of 0.2 to 5.0° C./sec, the holding is performed in this temperature range for 60 to 3010 seconds, and thereafter the cooling is performed so that the average cooling rate in 500° C. to 700° C. is 10° C./sec or faster.

When a holding temperature in the reheating step is lower than 600° C., a sufficient amount of alloy carbides cannot be precipitated in the grains, and a desired strength cannot be obtained. Therefore, the holding temperature is set to 600° C. or higher.

On the other hand, when the holding temperature is higher than 750° C., the alloy carbides in the grains are coarsened, and the number density of the alloy carbides in the grains decreases. As a result, a desired strength cannot be obtained. Therefore, the holding temperature is set to 750° C. or lower.

When a holding time is shorter than 60 seconds, a sufficient amount of the alloy carbides cannot be precipitated in the grains, and a desired strength cannot be obtained. Therefore, the holding time is set to 60 seconds or longer.

On the other hand, when the holding time is longer than 3,010 seconds, the alloy carbides in the grains are coarsened, and the number density of the alloy carbides in the grains decreases. As a result, a desired strength cannot be obtained. Therefore, the holding time is set to 3,010 seconds or shorter.

When the average heating rate in the temperature range of 600° C. to 750° C. is slower than 0.2° C./sec, dislocation recovery occurs, a desired strength cannot be obtained, and productivity further decreases. Therefore, the average heating rate in the temperature range of 600° C. to 750° C. is set to 0.2° C./sec or faster.

On the other hand, when the average heating rate in the temperature range of 600° C. to 750° C. is faster than 5.0° C./sec, the fuel cost required for heating increases. Therefore, the average heating rate in the temperature range of 600° C. to 750° C. is set to 5.0° C./sec or slower.

After the above-mentioned holding, cooling to, for example, a temperature range of 100° C. or lower is performed. During this cooling, the cooling is performed so that the average cooling rate in the temperature range of 500° C. to 700° C. is 10° C./sec or faster. When the average cooling rate in the temperature range of 500° C. to 700° C. is slower than 10° C./sec, the alloy carbides in the grains are coarsened, and the number density of the alloy carbides in the grains decreases. As a result, a desired strength cannot be obtained. Therefore, the average cooling rate in the temperature range of 500° C. to 700° C. is set to 10° C./sec or faster.

An upper limit of the average cooling rate in the temperature range of 500° C. to 700° C. is not particularly specified, and may be set to 200° C./sec or less from the viewpoint of suppressing an increase in cooling facilities.

EXAMPLES

Slabs having the chemical compositions shown in Table 1 were manufactured by continuous casting. Using the obtained slabs, steel sheets having a sheet thickness of 3.0 mm were manufactured under the conditions shown in Tables 2A to 3B. In the rough rolling step, rough rolling of 4 to 6 passes was performed.

Blanks in Table 1 indicate that the corresponding element is not intentionally contained.

For the obtained steel sheets, the area ratio of each microstructure, the number density of the alloy carbides, the tensile strength TS, and the hole expansion ratio λ were obtained by the above-described methods. The obtained results are shown in Tables 4A and 4B. In addition, in Test No. 10 in Table 3A, the reheating step was not performed.

In a case where the tensile strength TS was 1,030 MPa or more, the strength was high and determined to be acceptable. On the other hand, in a case where the tensile strength TS was less than 1,030 MPa, the strength was low and determined to be unacceptable.

In a case where the obtained hole expansion ratio λ was 30% or more, the hole expansibility was considered to be excellent, and determined to be acceptable. On the other hand, in a case where the hole expansion ratio λ was less than 30%, the hole expansibility was considered to be poor, determined to be unacceptable.

In addition, for the obtained steel sheets, a deterioration rate of the bendability after working was obtained by the following method. In this example, draw bending was performed as the working.

The draw bending was performed by forming a hat component under the conditions shown in FIG. 1. In the forming of the hat component, when a standing wall is formed, the steel sheet comes into contact with a punch while undergoing bending and bending back deformation. Therefore, a recessed part formed in a flat-R portion near a standing wall portion of a vehicle suspension component can be reproduced. A test piece subjected to the forming had a size of 240 mm in length and 50 mm in width with an L direction of the steel sheet as its longitudinal direction. In a bending test described later, a test piece was collected so that the standing wall portion of the hat component became a bent portion.

A strip-shaped test piece of 100 mm×30 mm was cut out from a ½ position in a width direction of the steel sheet. For bending (L-axis bending) in which a bending ridge was parallel to the rolling direction (L direction), a bending test was performed in accordance with the V-block method of JIS Z 2248:2006 (bending angle θ was 90°). A minimum bending radius R at which cracks did not occur was obtained and divided by the sheet thickness t to obtain a bending limit R/t.

However, regarding the presence or absence of cracks, a bent surface of the test piece after the bending test was observed with a magnifying mirror or an optical microscope at a magnification of 10-fold or more for cracks, and in a case where a crack length observed on the bent surface of the test piece was more than 0.5 mm, the presence of cracks was determined.

By performing the bending test before and after the draw bending according to the above-described method, R/t before the draw bending and R/t of a bent portion after the draw bending were obtained. In a case where a value obtained by dividing R/t before the draw bending by R/t of the bent portion after the draw bending was 0.5 or more, a little deterioration in the bendability after the working was determined, the value was determined to be acceptable, and "Good" was described in the tables. On the other hand, in a case where the value was 0.5 or less, large deterioration in the bendability after the working was determined, the value was determined to be unacceptable, and "NG" was described in the tables.

TABLE 1

| | Chemical composition (mass %) remainder including Fe and impurities | | | | | | | | | | | | | | |
|---|---|---|---|---|---|---|---|---|---|---|---|---|---|---|---|
| Steel | C | Si | Mn | Al | P | S | N | Ti | Nb | Mo | V | B | Cr | Ti + Nb + V + Mo | Note |
| A | 0.022 | 0.310 | 1.71 | 0.342 | 0.0088 | 0.0039 | 0.0036 | 0.130 | 0.012 | 0.003 | 0.100 | | 0.004 | 0.245 | Comparative Steel |
| B | 0.108 | 0.580 | 2.48 | 0.046 | 0.0084 | 0.0032 | 0.0024 | 0.130 | 0.020 | 0.102 | 0.200 | 0.0004 | | 0.452 | Present Invention Steel |
| C | 0.194 | 0.935 | 2.77 | 0.026 | 0.0107 | 0.0025 | 0.0036 | 0.130 | 0.013 | 0.003 | 0.100 | 0.0002 | 0.005 | 0.246 | Comparative Steel |

TABLE 1-continued

| Steel | Chemical composition (mass %) remainder including Fe and impurities | | | | | | | | | | | | | | |
|---|---|---|---|---|---|---|---|---|---|---|---|---|---|---|---|
| | C | Si | Mn | Al | P | S | N | Ti | Nb | Mo | V | B | Cr | Ti + Nb + V + Mo | Note |
| D | 0.083 | 0.062 | 2.43 | 0.501 | 0.0093 | 0.0043 | 0.0024 | 0.130 | 0.012 | 0.002 | 0.155 | | 0.003 | 0.299 | Present Invention Steel |
| E | 0.080 | 0.436 | 2.87 | 0.029 | 0.0075 | 0.0015 | 0.0038 | 0.130 | 0.010 | 0.002 | 0.200 | | 0.002 | 0.342 | Present Invention Steel |
| F | 0.096 | 1.011 | 2.99 | 0.255 | 0.0084 | 0.0037 | 0.0033 | 0.130 | 0.022 | 0.002 | 0.100 | 0.0003 | 0.003 | 0.254 | Present Invention Steel |
| G | 0.137 | 1.520 | 2.90 | 0.014 | 0.0095 | 0.0032 | 0.0038 | 0.130 | 0.021 | 0.002 | 0.200 | 0.0002 | 0.004 | 0.353 | Comparative Steel |
| H | 0.130 | 0.877 | 1.55 | 0.037 | 0.0063 | 0.0030 | 0.0015 | 0.130 | 0.014 | | 0.100 | 0.0003 | | 0.244 | Comparative Steel |
| I | 0.170 | 0.754 | 2.60 | 0.025 | 0.0074 | 0.0014 | 0.0035 | 0.130 | 0.012 | 0.003 | 0.200 | | 0.003 | 0.345 | Present Invention Steel |
| J | 0.092 | 0.504 | 3.17 | 0.015 | 0.0063 | 0.0027 | 0.0024 | 0.130 | 0.011 | | 0.100 | 0.0002 | | 0.241 | Comparative Steel |
| K | 0.178 | 1.299 | 2.88 | 0.024 | 0.0114 | 0.0028 | 0.0029 | 0.130 | 0.011 | 0.003 | 0.100 | | 0.004 | 0.244 | Present Invention Steel |
| L | 0.072 | 0.043 | 2.66 | 0.033 | 0.0084 | 0.0015 | 0.0035 | 0.130 | 0.037 | | 0.100 | | 0.002 | 0.267 | Present Invention Steel |
| M | 0.093 | 0.060 | 2.58 | 0.724 | 0.0087 | 0.0027 | 0.0024 | 0.130 | 0.011 | 0.003 | 0.100 | | 0.003 | 0.244 | Comparative Steel |
| N | 0.062 | 0.045 | 1.74 | 0.018 | 0.0093 | 0.0021 | 0.0027 | 0.130 | 0.030 | | 0.100 | 0.0002 | | 0.260 | Present Invention Steel |
| O | 0.073 | 0.043 | 2.70 | 0.025 | 0.0086 | 0.0034 | 0.0025 | 0.130 | 0.003 | | 0.100 | 0.0002 | 0.004 | 0.233 | Comparative Steel |
| P | 0.110 | 0.704 | 2.38 | 0.017 | 0.0068 | 0.0011 | 0.0031 | 0.130 | 0.036 | | 0.100 | | 0.003 | 0.266 | Present Invention Steel |
| Q | 0.131 | 0.523 | 2.03 | 0.028 | 0.0072 | 0.0024 | 0.0029 | 0.130 | 0.072 | 0.002 | 0.100 | | 0.004 | 0.304 | Comparative Steel |
| R | 0.156 | 1.075 | 2.05 | 0.022 | 0.0074 | 0.0039 | 0.0070 | 0.130 | 0.030 | 0.002 | 0.100 | 0.0002 | 0.002 | 0.262 | Comparative Steel |
| S | 0.130 | 0.588 | 3.05 | 0.038 | 0.0080 | 0.0021 | 0.0032 | 0.010 | 0.013 | 0.002 | 0.100 | 0.0014 | 0.003 | 0.125 | Comparative Steel |
| T | 0.146 | 0.598 | 2.86 | 0.106 | 0.0066 | 0.0024 | 0.0042 | 0.020 | 0.021 | 0.230 | | | 0.030 | 0.271 | Present Invention Steel |
| U | 0.158 | 0.880 | 2.35 | 0.028 | 0.0083 | 0.0026 | 0.0035 | 0.020 | 0.019 | 0.020 | 0.040 | 0.0003 | | 0.099 | Comparative Steel |
| V | 0.117 | 0.723 | 2.50 | 0.042 | 0.0084 | 0.0049 | 0.0032 | 0.200 | 0.038 | 0.068 | 0.200 | 0.0016 | 0.030 | 0.506 | Comparative Steel |
| W | 0.105 | 0.297 | 2.06 | 0.160 | 0.0080 | 0.0052 | 0.0042 | 0.130 | 0.019 | 0.620 | 0.063 | 0.0013 | 0.082 | 0.832 | Comparative Steel |
| X | 0.070 | 0.031 | 1.66 | 0.018 | 0.0067 | 0.0021 | 0.0031 | 0.130 | 0.031 | 0.081 | 0.310 | | 0.373 | 0.552 | Comparative Steel |
| Y | 0.105 | 1.207 | 2.52 | 0.022 | 0.0074 | 0.0010 | 0.0023 | 0.150 | 0.026 | | | | | 0.176 | Present Invention Steel |
| Z | 0.097 | 0.660 | 2.85 | 0.166 | 0.0630 | 0.0056 | 0.0042 | 0.175 | 0.026 | 0.590 | 0.290 | 0.0004 | | 1.081 | Present Invention Steel |
| AA | 0.144 | 0.490 | 2.31 | 0.080 | 0.0088 | 0.0043 | 0.0022 | 0.200 | 0.050 | 0.600 | 0.300 | 0.0026 | | 1.150 | Comparative Steel |

Underlines indicate outside of the range of the present invention.

TABLE 2A

| Test No. | Steel | Rough rolling: Slab heating temperature ° C. | Rough rolling: Minimum rolling reduction in first to third passes % | Rough rolling: Maximum rolling reduction in first to third passes % | Rough rolling: Minimum rolling reduction in fourth and subsequent passes % | Rough rolling: Maximum rolling reduction in fourth and subsequent passes % | Rough rolling: Temperature difference between final pass and pass one pass before final pass ° C. | Finish rolling: Final rolling reduction % | Finish rolling: Finish rolling temperature ° C. |
|---|---|---|---|---|---|---|---|---|---|
| 1 | A | 1225 | 15 | 21 | 26 | 40 | 27 | 42. | 971 |
| 2 | B | 1222 | 9 | 22 | 25 | 43 | 38 | 25 | 1022 |
| 3 | B | 1234 | 14 | 21 | 26 | 49 | 22 | 28 | 1038 |
| 4 | B | 1243 | 14 | 23 | 25 | 42 | 30 | 31 | 998 |
| 5 | B | 1229 | 17 | 20 | 14 | 40 | 29 | 44 | 992 |
| 6 | C | 1236 | 13 | 27 | 30 | 45 | 24 | 37 | 1055 |
| 7 | D | 1236 | 15 | 24 | 30 | 42 | 28 | 33 | 1059 |
| 8 | E | 1240 | 13 | 31 | 32 | 38 | 33 | 49 | 972 |
| 9 | E | 1238 | 13 | 24 | 25 | 51 | 41 | 54 | 994 |
| 10 | E | 1233 | 21 | 28 | 30 | 44 | 31 | 50 | 1000 |
| 11 | E | 1217 | 16 | 24 | 27 | 36 | 29 | 25 | 1032 |
| 12 | E | 1235 | 11 | 29 | 32 | 39 | 51 | 31 | 1045 |
| 13 | E | 1222 | 20 | 23 | 28 | 33 | 28 | 26 | 950 |
| 14 | F | 1220 | 12 | 25 | 27 | 45 | 48 | 41 | 978 |
| 15 | F | 1220 | 12 | 27 | 15 | 32 | 37 | 48 | 982 |
| 16 | F | 1225 | 18 | 22 | 31 | 40 | 26 | 34 | 1018 |
| 17 | F | 1219 | 14 | 28 | 28 | 38 | 28 | 38 | 972 |
| 18 | G | 1229 | 18 | 20 | 20 | 46 | 25 | 37 | 1056 |
| 19 | H | 1227 | 11 | 14 | 16 | 47 | 32 | 43 | 974 |
| 20 | I | 1230 | 24 | 27 | 18 | 29 | 26 | 48 | 990 |
| 21 | I | 1238 | 17 | 22 | 25 | 40 | 39 | 56 | 1012 |
| 22 | I | 1232 | 14 | 20 | 22 | 41 | 35 | 21 | 1045 |
| 23 | I | 1222 | 19 | 23 | 27 | 38 | 32 | 40 | 1034 |
| 24 | J | Slab cracks occurred | | | | | | | |
| 25 | K | 1251 | 12 | 25 | 35 | 42 | 37 | 50 | 1022 |

Underlines indicate outside of the range of the present invention.

TABLE 2B

| Test No. | Steel | Rough rolling: Slab heating temperature ° C. | Rough rolling: Minimum rolling reduction in first to third passes % | Rough rolling: Maximum rolling reduction in first to third passes % | Rough rolling: Minimum rolling reduction in fourth and subsequent passes % | Rough rolling: Maximum rolling reduction in fourth and subsequent passes % | Rough rolling: Temperature difference between final pass and pass one pass before final pass ° C. | Finish rolling: Final rolling reduction % | Finish rolling: Finish rolling temperature ° C. |
|---|---|---|---|---|---|---|---|---|---|
| 26 | L | 1227 | 13 | 22 | 20 | 42 | 31 | 56 | 1020 |
| 27 | L | 1229 | 22 | 26 | 28 | 41 | 45 | 51 | 1007 |
| 28 | L | 1232 | 16 | 26 | 37 | 40 | 21 | 20 | 1034 |
| 29 | M | Nozzle clogging occurred | | | | | | | |
| 30 | N | 974 | 18 | 20 | 21 | 42 | 44 | 37 | 966 |
| 31 | N | 1230 | 13 | 21 | 23 | 31 | 42 | 42 | 982 |
| 32 | N | 1223 | 14 | 28 | 29 | 36 | 37 | 37 | 1051 |
| 33 | O | 1230 | 14 | 20 | 21 | 33 | 35 | 39 | 965 |
| 34 | P | 1241 | 13 | 23 | 28 | 46 | 31 | 25 | 1040 |
| 35 | Q | Slab cracks occurred | | | | | | | |
| 36 | R | 1320 | 16 | 29 | 30 | 47 | 27 | 56 | 1017 |
| 37 | S | 1272 | 11 | 25 | 26 | 44 | 31 | 33 | 962 |
| 38 | T | 1269 | 13 | 20 | 21 | 48 | 29 | 30 | 1050 |
| 39 | T | 1238 | 18 | 21 | 27 | 43 | 26 | 31 | 1040 |
| 40 | U | 1223 | 21 | 26 | 30 | 34 | 32 | 46 | 989 |
| 41 | V | 1223 | 14 | 26 | 32 | 40 | 41 | 25 | 1021 |
| 42 | W | 1242 | 19 | 28 | 36 | 41 | 40 | 50 | 1005 |
| 43 | X | 1256 | 15 | 21 | 24 | 37 | 45 | 45 | 1034 |
| 44 | Y | 1242 | 15 | 23 | 25 | 30 | 42 | 35 | 980 |
| 45 | Z | 1197 | 17 | 22 | 36 | 41 | 23 | 37 | 995 |
| 46 | AA | 1258 | 20 | 16 | 20 | 33 | 42 | 40 | 1022 |
| 47 | Y | 1230 | 15 | 26 | 25 | 31 | 39 | 34 | 985 |
| 48 | E | 1256 | 19 | 18 | 40 | 36 | 31 | 42 | 1033 |

TABLE 2B-continued

| Test No. | Steel | Rough rolling: Slab heating temperature ° C. | Rough rolling: Minimum rolling reduction in first to third passes % | Rough rolling: Maximum rolling reduction in first to third passes % | Rough rolling: Minimum rolling reduction in fourth and subsequent passes % | Rough rolling: Maximum rolling reduction in fourth and subsequent passes % | Rough rolling: Temperature difference between final pass and pass one pass before final pass ° C. | Finish rolling: Final rolling reduction % | Finish rolling: Finish rolling temperature ° C. |
|---|---|---|---|---|---|---|---|---|---|
| 49 | F | 1140 | 13 | 20 | 39 | 41 | 35 | 45 | 1016 |
| 50 | F | 1260 | 14 | 24 | 29 | 39 | 24 | 38 | 979 |
| 51 | F | 1260 | 16 | 25 | 36 | 43 | 46 | 44 | 1027 |

Underlines indicate outside of the range of the present invention.

TABLE 3A

| Test No. | Steel | Cooling: Average cooling rate in temperature range of 900° C. to 650° C. ° C./sec | Coiling: Coiling temperature ° C. | Light reduction: Cumulative rolling reduction % | Reheating: Average heating rate ° C./sec | Reheating: Heating temperature during heat treatment ° C. | Reheating: Holding time during heat treatment sec | Reheating: Average cooling rate in temperature range of 500° C. to 700° C. ° C./sec | Note |
|---|---|---|---|---|---|---|---|---|---|
| 1 | A | 132 | 432 | 5 | 0.4 | 711 | 501 | 14 | Comparative Example |
| 2 | B | 186 | 504 | 5 | 3.2 | 710 | 795 | 19 | Comparative Example |
| 3 | B | 71 | 567 | 10 | 0.4 | 713 | 2000 | 13 | Present Invention Example |
| 4 | B | 168 | 486 | 5 | 1.9 | 665 | 1265 | 15 | Present Invention Example |
| 5 | B | 141 | 402 | 10 | 1.8 | 696 | 2912 | 11 | Comparative Example |
| 6 | C | 198 | 477 | 5 | 4.8 | 681 | 2853 | 15 | Comparative Example |
| 7 | D | 66 | 560 | 0 | 0.7 | 642 | 1765 | 18 | Present Invention Example |
| 8 | E | 107 | 431 | 0 | 2.5 | 738 | 2588 | 18 | Comparative Example |
| 9 | E | 158 | 485 | 0 | 2.7 | 623 | 1354 | 12 | Comparative Example |
| 10 | E | 161 | 490 | 15 | 4.9 | 0 | 0 | 0 | Comparative Example |
| 11 | E | 193 | 501 | 0 | 3.3 | 741 | 795 | 13 | Present Invention Example |
| 12 | E | 178 | 508 | 0 | 1.9 | 738 | 648 | 11 | Comparative Example |
| 13 | E | 95 | 551 | 5 | 0.2 | 699 | 971 | 17 | Comparative Example |
| 14 | F | 37 | 456 | 10 | 0.8 | 720 | 501 | 10 | Present Invention Example |
| 15 | F | 28 | 414 | 5 | 0.2 | 632 | 1824 | 15 | Comparative Example |
| 16 | F | 195 | 526 | 5 | 1.3 | 606 | 1118 | 13 | Present Invention Example |
| 17 | F | 132 | 501 | 5 | 0.9 | 705 | 2912 | 11 | Present Invention Example |
| 18 | G | 37 | 521 | 10 | 2.3 | 738 | 1060 | 12 | Comparative Example |
| 19 | H | 125 | 452 | 10 | 4.2 | 707 | 119 | 19 | Comparative Example |
| 20 | I | 96 | 405 | 5 | 0.2 | 760 | 2089 | 13 | Comparative Example |
| 21 | I | 178 | 508 | 5 | 0.7 | 738 | 913 | 13 | Present Invention Example |
| 22 | I | 54 | 539 | 10 | 1.5 | 603 | 1207 | 16 | Comparative Example |
| 23 | I | 178 | 490 | 10 | 0.1 | 696 | 148 | 21 | Comparative Example |
| 24 | J | | | | Slab cracks occurred | | | | Comparative Example |
| 25 | K | 52 | 484 | 5 | 2.5 | 638 | 873 | 16 | Present Invention Example |

Underlines indicate outside of the range of the present invention.

TABLE 3B

| Test No. | Steel | Cooling: Average cooling rate in temperature range of 900° C. to 650° C. ° C./sec | Coiling: Coiling temperature ° C. | Light reduction: Cumulative rolling reduction % | Reheating: Average heating rate ° C./sec | Reheating: Heating temperature during heat treatment ° C. | Reheating: Holding time during heat treatment sec | Reheating: Average cooling rate in temperature range of 500° C. to 700° C. ° C./sec | Note |
|---|---|---|---|---|---|---|---|---|---|
| 26 | L | 37 | 522 | 10 | 0.5 | 710 | 1236 | 12 | Present Invention Example |
| 27 | L | 198 | 553 | 5 | 2.0 | 666 | 2059 | 20 | Present Invention Example |

TABLE 3B-continued

| Test No. | Steel | Cooling Average cooling rate in temperature range of 900° C. to 650° C. ° C./sec | Coiling Coiling temperature ° C. | Light reduction Cumulative rolling reduction % | Reheating Average heating rate ° C./sec | Reheating Heating temperature during heat treatment ° C. | Reheating Holding time during heat treatment sec | Reheating Average cooling rate in temperature range of 500° C. to 700° C. ° C./sec | Note |
|---|---|---|---|---|---|---|---|---|---|
| 28 | L | 98 | 420 | 0 | 1.7 | 645 | 2471 | 9 | Comparative Example |
| 29 | M | | | Nozzle clogging occurred | | | | | Comparative Example |
| 30 | N | 98 | 575 | 0 | 2.6 | 641 | 1971 | 18 | Comparative Example |
| 31 | N | 125 | 600 | 0 | 0.4 | 690 | 2735 | 15 | Comparative Example |
| 32 | N | 81 | 567 | 0 | 3.1 | 678 | 1618 | 14 | Present Invention Example |
| 33 | Q | 124 | 450 | 0 | 3.9 | 702 | 60 | 11 | Comparative Example |
| 34 | P | 56 | 569 | 0 | 2.0 | 678 | 2324 | 14 | Present Invention Example |
| 35 | Q | | | Slab cracks occurred | | | | | Comparative Example |
| 36 | R | 193 | 513 | 0 | 1.0 | 741 | 103 | 13 | Comparative Example |
| 37 | S | 103 | 567 | 0 | 1.1 | 600 | 1706 | 18 | Comparative Example |
| 38 | T | 86 | 575 | 0 | 3.9 | 642 | 1912 | 18 | Present Invention Example |
| 39 | T | 10 | 468 | 0 | 2.5 | 651 | 14760 | 8 | Comparative Example |
| 40 | U | 139 | 423 | 0 | 0.4 | 674 | 2530 | 19 | Comparative Example |
| 41 | V | 79 | 423 | 0 | 2.8 | 665 | 2147 | 14 | Comparative Example |
| 42 | W | 181 | 515 | 0 | 4.1 | 743 | 1148 | 25 | Comparative Example |
| 43 | X | 42 | 429 | 0 | 1.7 | 611 | 2530 | 16 | Comparative Example |
| 44 | Y | 31 | 405 | 0 | 0.5 | 602 | 61 | 18 | Present Invention Example |
| 45 | Z | 201 | 440 | 5 | 2.2 | 635 | 1259 | 19 | Present Invention Example |
| 46 | AA | 121 | 482 | 10 | 2.7 | 612 | 1424 | 21 | Comparative Example |
| 47 | Y | 173 | 506 | 0 | 2.5 | 627 | 1995 | 17 | Present Invention Example |
| 48 | E | 206 | 387 | 5 | 3.5 | 726 | 2156 | 17 | Comparative Example |
| 49 | F | 117 | 471 | 10 | 1.7 | 582 | 2744 | 14 | Comparative Example |
| 50 | F | 74 | 497 | 10 | 2.4 | 688 | 3017 | 18 | Comparative Example |
| 51 | F | 135 | 433 | 5 | 4.2 | 641 | 1638 | 11 | Present Invention Example |

Underlines indicate outside of the range of the present invention.

TABLE 4A

| Test No. | Steel | Number density of alloy carbides present at grain boundaries/cm$^2$ | Number density of alloy carbides present in grains/cm$^2$ | B area % | $\alpha + P + \gamma$ area % | FM + TM area % | Proportion of TM % | Tensile strength MPa | Hole expansion ratio % | Deterioration in bendability after bending | Note |
|---|---|---|---|---|---|---|---|---|---|---|---|
| 1 | A | $7.4 \times 10^8$ | $5.7 \times 10^{16}$ | 72.3 | 27.3 | 0.4 | 86.9 | 981 | 61 | Good | Comparative Example |
| 2 | B | $5.5 \times 10^7$ | $2.5 \times 10^{18}$ | 82.3 | 15.6 | 2.1 | 90.9 | 1268 | 45 | NG | Comparative Example |
| 3 | B | $4.3 \times 10^8$ | $5.8 \times 10^{18}$ | 87.1 | 12.0 | 0.9 | 82.4 | 1277 | 36 | Good | Present Invention Example |
| 4 | B | $8.2 \times 10^{10}$ | $8.5 \times 10^{18}$ | 87.3 | 11.7 | 1.0 | 77.0 | 1257 | 36 | Good | Present Invention Example |
| 5 | B | $6.3 \times 10^7$ | $9.3 \times 10^{18}$ | 88.4 | 10.3 | 1.3 | 78.4 | 1301 | 37 | NG | Comparative Example |
| 6 | C | $3.3 \times 10^8$ | $7.7 \times 10^{18}$ | 68.3 | 0.7 | 31.0 | 75.9 | 1268 | 26 | Good | Comparative Example |
| 7 | D | $2.4 \times 10^{10}$ | $9.7 \times 10^{17}$ | 81.1 | 16.2 | 2.7 | 89.3 | 1184 | 47 | Good | Present Invention Example |
| 8 | E | $1.7 \times 10^7$ | $1.9 \times 10^{17}$ | 84.1 | 15.4 | 0.5 | 90.3 | 1093 | 58 | NG | Comparative Example |
| 9 | E | $3.3 \times 10^7$ | $1.3 \times 10^{16}$ | 83.3 | 16.5 | 0.2 | 79.0 | 1053 | 22 | NG | Comparative Example |
| 10 | E | $1.2 \times 10^7$ | $4.9 \times 10^{16}$ | 82.0 | 17.6 | 0.4 | 20.0 | 107.1 | 35 | NG | Comparative Example |
| 11 | E | $6.7 \times 10^8$ | $4.3 \times 10^{17}$ | 84.5 | 15.2 | 0.3 | 80.2 | 1120 | 45 | Good | Present Invention Example |
| 12 | E | $2.3 \times 10^7$ | $1.5 \times 10^{17}$ | 83.0 | 16.4 | 0.6 | 83.1 | 1100 | 54 | NG | Comparative Example |
| 13 | E | $5.5 \times 10^7$ | $9.8 \times 10^{16}$ | 81.5 | 18.1 | 0.4 | 78.5 | 1036 | 20 | NG | Comparative Example |
| 14 | F | $1.7 \times 10^{10}$ | $2.5 \times 10^{16}$ | 82.5 | 13.7 | 3.8 | 81.9 | 1046 | 41 | Good | Present Invention Example |
| 15 | F | $4.1 \times 10^9$ | $7.6 \times 10^{16}$ | 69.8 | 25.0 | 5.2 | 89.1 | 992 | 41 | NG | Comparative Example |

TABLE 4A-continued

| Test No. | Steel | Number density of alloy carbides present at grain boundaries/cm$^2$ | Number density of alloy carbides present in grains/cm$^2$ | B area % | α + P + γ area % | FM + TM area % | Proportion of TM % | Tensile strength MPa | Hole expansion ratio % | Deterioration in bendability after bending | Note |
|---|---|---|---|---|---|---|---|---|---|---|---|
| 16 | F | $1.2 \times 10^{10}$ | $8.7 \times 10^{17}$ | 82.3 | 15.5 | 2.2 | 87.9 | 1088 | 36 | Good | Present Invention Example |
| 17 | F | $2.0 \times 10^{9}$ | $2.1 \times 10^{16}$ | 82.2 | 12.5 | 5.3 | 88.5 | 1043 | 41 | Good | Present Invention Example |
| 18 | G | $6.7 \times 10^{9}$ | $9.5 \times 10^{18}$ | 66.3 | 24.0 | 9.7 | 78.7 | 1305 | 21 | Good | Comparative Example |
| 19 | H | $9.6 \times 10^{8}$ | $9.6 \times 10^{16}$ | 71.3 | 26.6 | 2.1 | 85.5 | 969 | 42 | Good | Comparative Example |
| 20 | I | $5.3 \times 10^{8}$ | $7.5 \times 10^{15}$ | 73.0 | 3.0 | 24.0 | 74.7 | 977 | 15 | Good | Comparative Example |
| 21 | I | $8.0 \times 10^{8}$ | $8.9 \times 10^{18}$ | 83.8 | 13.0 | 3.2 | 76.5 | 1258 | 35 | Good | Present Invention Example |
| 22 | I | $2.8 \times 10^{7}$ | $6.0 \times 10^{18}$ | 88.6 | 4.2 | 7.2 | 78.6 | 1333 | 20 | NG | Comparative Example |
| 23 | I | $9.3 \times 10^{8}$ | $4.1 \times 10^{16}$ | 86.3 | 5.4 | 8.3 | 80.7 | 1008 | 34 | Good | Comparative Example |
| 24 | J | | | | Slab cracks occurred | | | | | | Comparative Example |
| 25 | K | $9.9 \times 10^{10}$ | $6.8 \times 10^{17}$ | 83.4 | 14.4 | 2.2 | 85.9 | 1165 | 32 | Good | Present Invention Example |

Underlines indicate outside of the range of the present invention. and undesirable properties.

TABLE 4B

| Test No. | Steel | Number density of alloy carbides present at grain boundaries/cm$^2$ | Number density of alloy carbides present in grains/cm$^2$ | B area % | α + P + γ area % | FM + TM area % | Proportion of TM % | Tensile strength MPa | Hole expansion ratio % | Deterioration in bendability after bending | Note |
|---|---|---|---|---|---|---|---|---|---|---|---|
| 26 | L | $4.4 \times 10^{8}$ | $7.0 \times 10^{16}$ | 82.2 | 15.7 | 2.1 | 93.2 | 1034 | 48 | Good | Present Invention Example |
| 27 | L | $6.3 \times 10^{8}$ | $7.3 \times 10^{16}$ | 80.2 | 17.5 | 2.3 | 95.2 | 1033 | 54 | Good | Present Invention Example |
| 28 | L | $1.8 \times 10^{7}$ | $4.0 \times 10^{15}$ | 81.4 | 17.3 | 1.3 | 78.0 | 1025 | 25 | NG | Comparative Example |
| 29 | M | | | | Nozzle clogging occurred | | | | | | Comparative Example |
| 30 | N | $3.7 \times 10^{11}$ | $2.1 \times 10^{16}$ | 83.2 | 15.1 | 1.7 | 83.9 | 975 | 35 | NG | Comparative Example |
| 31 | N | $7.1 \times 10^{8}$ | $9.8 \times 10^{15}$ | 54.7 | 44.0 | 1.3 | 82.3 | 967 | 42 | Good | Comparative Example |
| 32 | N | $1.0 \times 10^{9}$ | $9.3 \times 10^{16}$ | 82.9 | 16.0 | 1.1 | 80.0 | 1036 | 51 | Good | Present Invention Example |
| 33 | O | $8.6 \times 10^{8}$ | $1.0 \times 10^{16}$ | 81.8 | 16.8 | 1.4 | 83.0 | 951 | 61 | Good | Comparative Example |
| 34 | P | $7.9 \times 10^{9}$ | $8.7 \times 10^{18}$ | 87.3 | 10.5 | 2.2 | 84.8 | 1282 | 36 | Good | Present Invention Example |
| 35 | Q | | | | Slab cracks occurred | | | | | | Comparative Example |
| 36 | R | $5.5 \times 10^{8}$ | $1.9 \times 10^{18}$ | 77.0 | 1.0 | 22.0 | 79.0 | 1264 | 21 | Good | Comparative Example |
| 37 | S | $9.3 \times 10^{9}$ | $6.2 \times 10^{15}$ | 82.3 | 14.6 | 3.1 | 81.7 | 955 | 45 | Good | Comparative Example |
| 38 | T | $9.0 \times 10^{9}$ | $4.9 \times 10^{17}$ | 83.2 | 12.6 | 4.2 | 84.6 | 1209 | 36 | Good | Present Invention Example |
| 39 | T | $1.6 \times 10^{8}$ | $7.7 \times 10^{15}$ | 74.1 | 19.9 | 6.0 | 75.7 | 991 | 22 | Good | Comparative Example |
| 40 | U | $4.1 \times 10^{10}$ | $8.1 \times 10^{15}$ | 89.9 | 7.0 | 3.1 | 79.2 | 979 | 36 | Good | Comparative Example |
| 41 | V | $1.2 \times 10^{10}$ | $1.7 \times 10^{19}$ | 84.2 | 12.4 | 3.4 | 76.9 | 1249 | 15 | Good | Comparative Example |
| 42 | W | $3.5 \times 10^{9}$ | $3.8 \times 10^{19}$ | 83.2 | 14.5 | 2.3 | 78.7 | 1234 | 22 | Good | Comparative Example |
| 43 | X | $6.8 \times 10^{9}$ | $1.5 \times 10^{19}$ | 85.2 | 13.8 | 1.0 | 76.4 | 1181 | 21 | Good | Comparative Example |
| 44 | Y | $1.7 \times 10^{8}$ | $0.3 \times 10^{17}$ | 82.2 | 13.8 | 4.0 | 85.0 | 1160 | 36 | Good | Present Invention Example |

TABLE 4B-continued

| Test No. | Steel | Number density of alloy carbides present at grain boundaries/cm$^2$ | Number density of alloy carbides present in grains/cm$^2$ | B area % | α + P + γ area % | FM + TM area % | Proportion of TM % | Tensile strength MPa | Hole expansion ratio % | Deterioration in bendability after bending | Note |
|---|---|---|---|---|---|---|---|---|---|---|---|
| 45 | Z | $8.1 \times 10^{10}$ | $8.8 \times 10^{18}$ | 82.3 | 13.5 | 4.2 | 81.0 | 1260 | 37 | Good | Present Invention Example |
| 46 | AA | $4.2 \times 10^{10}$ | $5.7 \times 10^{18}$ | 82.4 | 11.6 | 6.0 | 82.0 | 1287 | 13 | Good | Comparative Example |
| 47 | Y | $4.7 \times 10^{8}$ | $2.5 \times 10^{17}$ | 81.8 | 10.7 | 7.5 | 82.3 | 1186 | 31 | Good | Present Invention Example |
| 48 | E | $7.2 \times 10^{8}$ | $1.9 \times 10^{18}$ | 45.1 | 15.4 | 39.5 | 81.7 | 1093 | 18 | Good | Comparative Example |
| 49 | F | $3.3 \times 10^{9}$ | $7.2 \times 10^{15}$ | 83.3 | 13.3 | 3.4 | 81.0 | 982 | 15 | Good | Comparative Example |
| 50 | F | $1.6 \times 10^{10}$ | $5.5 \times 10^{15}$ | 80.6 | 17.1 | 2.3 | 77.7 | 946 | 19 | Good | Comparative Example |
| 51 | F | $4.7 \times 10^{9}$ | $8.1 \times 10^{17}$ | 82.1 | 16.9 | 1.0 | 83.6 | 1089 | 42 | Good | Present Invention Example |

Underlines indicate outside of the range of the present invention. and undesirable properties.

Referring to Tables 4A and 4B, it can be seen that the steel sheets according to present invention examples had high strength, excellent hole expansibility, and a little deterioration in bendability after working.

On the other hand, it can be seen that the steel sheets according to comparative examples were inferior in any one or more of the properties.

INDUSTRIAL APPLICABILITY

According to the above aspect of the present invention, it is possible to provide a steel sheet having high strength, excellent hole expansibility, and a little deterioration in bendability after working, and a method of manufacturing the same. In addition, according to a preferred aspect of the present invention, it is possible to provide a steel sheet having superior hole expansibility and a method of manufacturing the same.

What is claimed is:

1. A steel sheet comprising, as a chemical composition, by mass %:

C: 0.030% to 0.180%;
Si: 0.030% to 1.400%;
Mn: 1.60% to 3.00%;
Al: 0.010% to 0.700%;
P: 0.0800% or less;
S: 0.0100% or less;
N: 0.0050% or less;
Ti: 0.020% to 0.180%;
Nb: 0.010% to 0.050%;
Mo: 0% to 0.600%;
V: 0% to 0.300%;
a sum of Ti, Nb, Mo, and V: 0.100% to 1.130%;
B: 0% to 0.0030%;
Cr: 0% to 0.500%; and
a remainder consisting of Fe and impurities,
wherein a microstructure of the steel sheet contains, by area %,
bainite: 80.0% or more,
a sum of fresh martensite and tempered martensite: 20.0% or less, and
a sum of pearlite, ferrite, and austenite: 20.0% or less,
a number density of alloy carbides present at grain boundaries and having a major axis of 10 to 100 nm is $1.0\times10^{8}$ to $1.0\times10^{11}$/cm$^2$,
a number density of alloy carbides present in grains and having a major axis of 10 nm or less is $1.0\times10^{16}$ to $1.0\times10^{19}$/cm$^3$, and
a tensile strength of the steel sheet is 1,030 MPa or more.

2. The steel sheet according to claim 1,
wherein a proportion of an area ratio of the tempered martensite in a sum of area ratios of the fresh martensite and the tempered martensite is 80.0% or more.

3. The steel sheet according to claim 1,
wherein the steel sheet contains, as the chemical composition, by mass %, one or more of
Mo: 0.001% to 0.600%,
V: 0.010% to 0.300%,
B: 0.0001% to 0.0030%, and
Cr: 0.001% to 0.500%.

4. A method of manufacturing the steel sheet according to claim 1, comprising:
heating a slab having the chemical composition according to claim 1 and performing rough rolling of four passes or more in a temperature range of 1,000° C. to 1,300° C.;
performing finish rolling after the rough rolling so that a final rolling reduction is 24% to 60% and a finish rolling temperature is in a temperature range of 960° C. to 1,060° C.;
performing cooling after the finish rolling so that an average cooling rate in a temperature range of 900° C. to 650° C. is 30° C./sec or faster;
performing coiling in a temperature range of 400° C. to 580° C. after the cooling; and
after the coiling, performing heating to a temperature range of 600° C. to 750° C. at an average heating rate of 0.2 to 5.0° C./sec, performing holding in the temperature range of 600° C. to 750° C. for 60 to 3,010 seconds, and performing cooling so that an average cooling rate in a temperature range of 500° C. to 700° C. is 10° C./sec or faster,
wherein, in the rough rolling,
a temperature difference between a final pass and a pass one pass before the final pass is set to 50° C. or less,
a rolling reduction in first to third passes is set to 10% to 30%, and
a rolling reduction in fourth and subsequent passes is set to 15% to 50%.

5. The steel sheet according to claim 2, wherein the steel sheet contains, as the chemical composition, by mass %, one or more of Mo: 0.001% to 0.600%, V: 0.010% to 0.300%, B: 0.0001% to 0.0030%, and Cr: 0.001% to 0.500%.

6. A steel sheet comprising, as a chemical composition, by mass %:

C: 0.030% to 0.180%;

Si: 0.030% to 1.400%;

Mn: 1.60% to 3.00%;

Al: 0.010% to 0.700%;

P: 0.0800% or less;

S: 0.0100% or less;

N: 0.0050% or less;

Ti: 0.020% to 0.180%;

Nb: 0.010% to 0.050%;

Mo: 0% to 0.600%;

V: 0% to 0.300%;

a sum of Ti, Nb, Mo, and V: 0.100% to 1.130%;

B: 0% to 0.0030%;

Cr: 0% to 0.500%; and a remainder comprising Fe and impurities, wherein a microstructure of the steel sheet contains, by area %, bainite: 80.0% or more, a sum of fresh martensite and tempered martensite: 20.0% or less, and a sum of pearlite, ferrite, and austenite: 20.0% or less, a number density of alloy carbides present at grain boundaries and having a major axis of 10 to 100 nm is $1.0\times10^{8}$ to $1.0\times10^{11}/cm^{2}$, a number density of alloy carbides present in grains and having a major axis of 10 nm or less is $1.0\times10^{16}$ to $1.0\times10^{19}/cm^{3}$, and a tensile strength of the steel sheet is 1,030 MPa or more.

* * * * *